US005435754A

United States Patent [19]

Hotea et al.

[11] Patent Number: 5,435,754

[45] Date of Patent: Jul. 25, 1995

[54] SHUNTED AIRBAG CONNECTOR

[75] Inventors: Gheorghe Hotea, Griesheim; Rolf Jetter; Andreas Wilkner, both of Darmstadt, all of Germany

[73] Assignee: The Whitaker Corporation, Wilmington, Del.

[21] Appl. No.: 336,885

[22] Filed: Nov. 9, 1994

Related U.S. Application Data

[63] Continuation of Ser. No. 142,893, Oct. 25, 1993, abandoned.

[30] Foreign Application Priority Data

Dec. 1, 1992 [GB] United Kingdom ..... 9225118

[51] Int. Cl.[6] ..... H01R 13/66

[52] U.S. Cl. ..... 439/620; 439/854

[58] Field of Search ..... 439/620–622, 439/466, 468, 473, 694, 854, 855

[56] References Cited

U.S. PATENT DOCUMENTS

| | | | |
|---|---|---|---|
| 3,636,495 | 1/1972 | Forsyth, Jr. | 439/466 |
| 4,113,340 | 9/1978 | Rapata . | |
| 4,113,341 | 9/1978 | Hughes . | |
| 4,116,524 | 9/1978 | DeNigris et al. | 439/620 |
| 4,447,105 | 5/1984 | Ruehl | 439/620 |
| 4,679,885 | 7/1987 | Nestor et al. | 439/620 |
| 4,778,405 | 10/1988 | Sterken | 439/395 |
| 4,952,169 | 8/1990 | Hayes, Sr. et al. | 439/403 |
| 5,154,689 | 10/1992 | Knoll et al. | 439/620 |
| 5,167,538 | 12/1992 | Stoerk | 439/620 |
| 5,314,345 | 5/1994 | Cahaly et al. | 439/188 |

FOREIGN PATENT DOCUMENTS

| | | |
|---|---|---|
| 0579884 | 1/1994 | European Pat. Off. . |
| 3814016A1 | 11/1989 | Germany . |
| 2250645A | 6/1992 | United Kingdom . |
| 2267188 | 11/1993 | United Kingdom . |
| 92/15129 | 9/1992 | WIPO . |

*Primary Examiner*—Gary F. Paumen

*Attorney, Agent, or Firm*—Eric J. Groen; Driscoll A. Nina; Adrian J. LaRue

[57] ABSTRACT

An airbag connector includes an insulating housing having a plurality of electrical terminals where the terminals include mating sections and wire terminating sections at, where the sections form a right angle with respect to one another. The terminals further include a lead receiving slot for a suppression device, such as a capacitor or resistor. A housing can be connected directly with the igniter and has a shunt which shunts the igniter pins when in the unmated version.

24 Claims, 12 Drawing Sheets

SHUNTED AIRBAG CONNECTOR

This application is a Continuation of application Ser. No. 08/142,893 filed Oct. 25, 1993, now abandoned.

BACKGROUND OF THE INVENTION

1. Field of the Invention

This invention relates to an electrical connector for use with an airbag igniter system.

2. Description of the Prior Art

It is sometimes required to provide an electrical connector for the connection of two electrical conductors, for example electrical leads, with means for the interposition between the conductors of an electrical suppression device, for example a resistor, or a capacitor. Where for example in an airbag igniter system, where the electrical connection is made with the igniter, a suppression device is sometimes placed between adjacent terminals to suppress the signal of the igniter. Typically these igniters include a suppression device which is soldered between adjacent contacts which increases the cost of the manufacturing of the product, as well as the reliability of the connection. Typically such connections also include a shunting feature, which shunts between adjacent contacts when in a disconnected mode, whereby the connection of the two connectors breaks the shunt allowing the connection with the ignitor.

SUMMARY OF THE INVENTION

It is an object of the present invention to provide an electrical connection system having the above mentioned features where the suppression device and wires to be connected are all assembable to the connector using automatic tooling.

The objects of the invention were accomplished by providing an electrical connector having a suppression device electrically connected between terminals in a housing, the connector is characterized in that the housing has a receiving section for a suppression device and in that the terminals include an additional wire receiving slot, or leads of the suppression device are terminated in the additional wire receiving slots.

BRIEF DESCRIPTION OF THE DRAWINGS

FIG. 13 shows the two connectors in a fully mated condition; and

DETAILED DESCRIPTION OF THE PREFERRED EMBODIMENT

Figure 12:
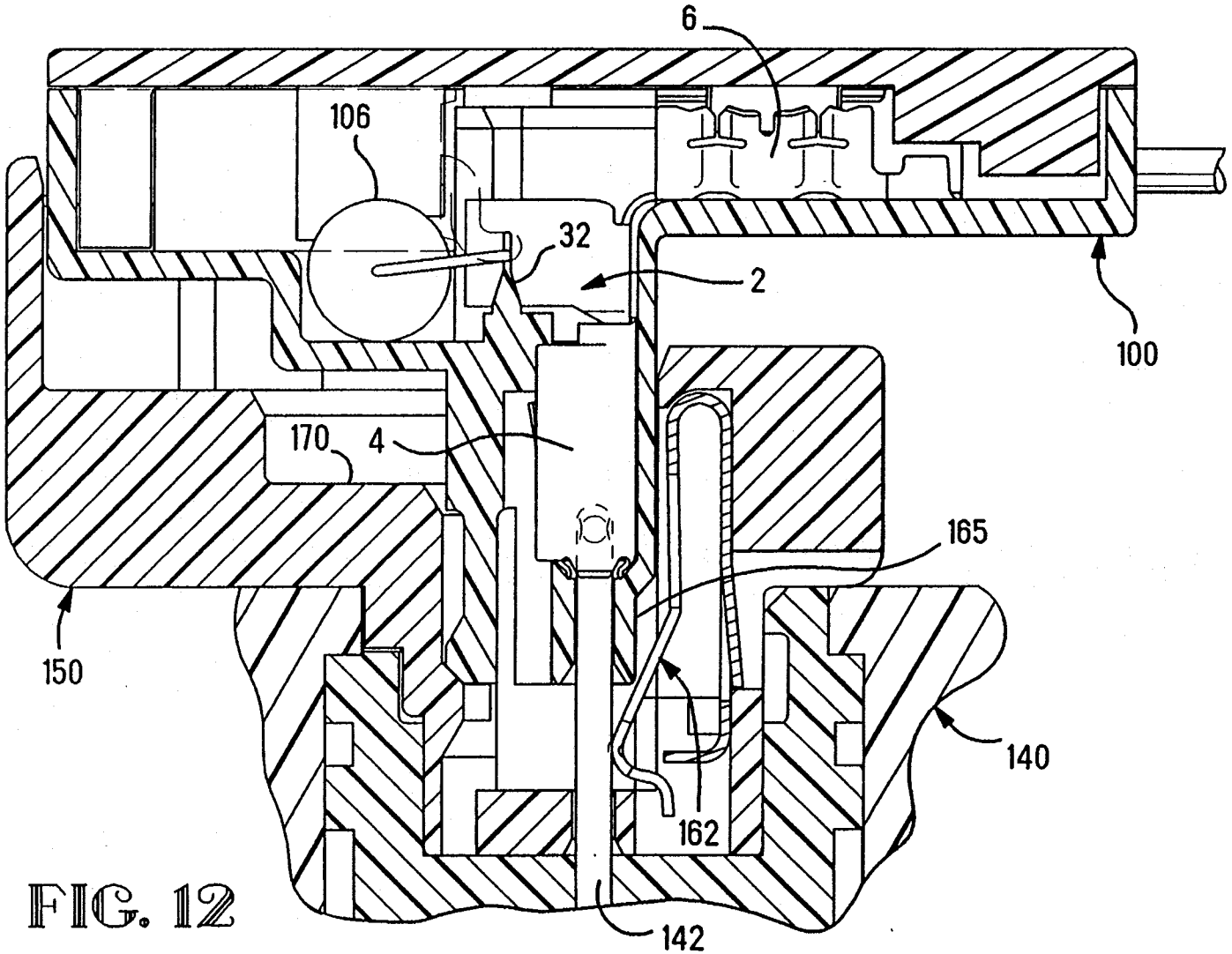
FIG. 12 is a view similar to that of FIGS. 10 and 11, showing the connector of FIG. 10 in a partially connected configuration with the housing of FIG. 11.
Figure 18:
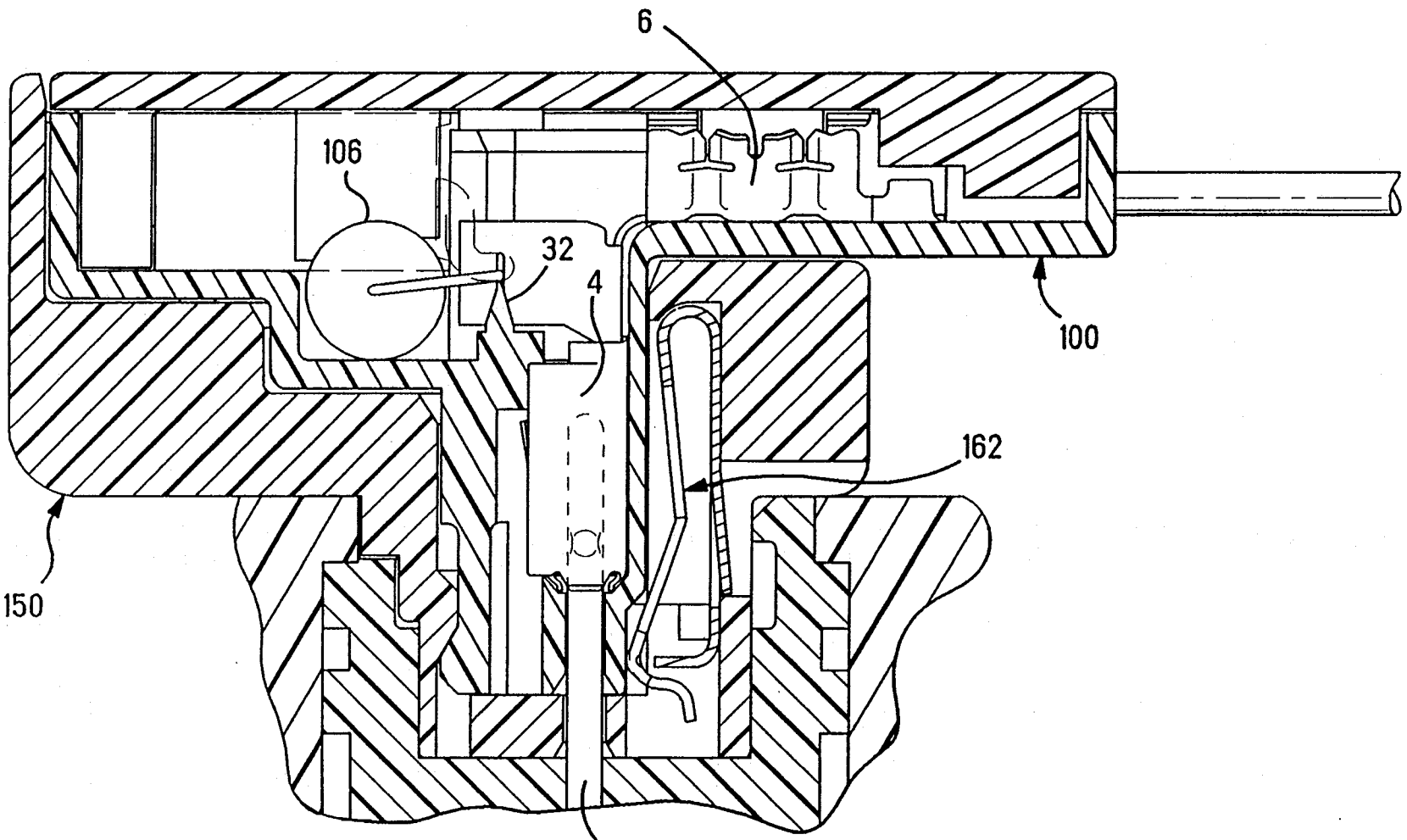

With reference first to FIG. 12, an electrical airbag connector includes a housing member 100 carrying terminals 2, and a housing portion 150 which surrounds the igniter pins 142.

Figure 1:
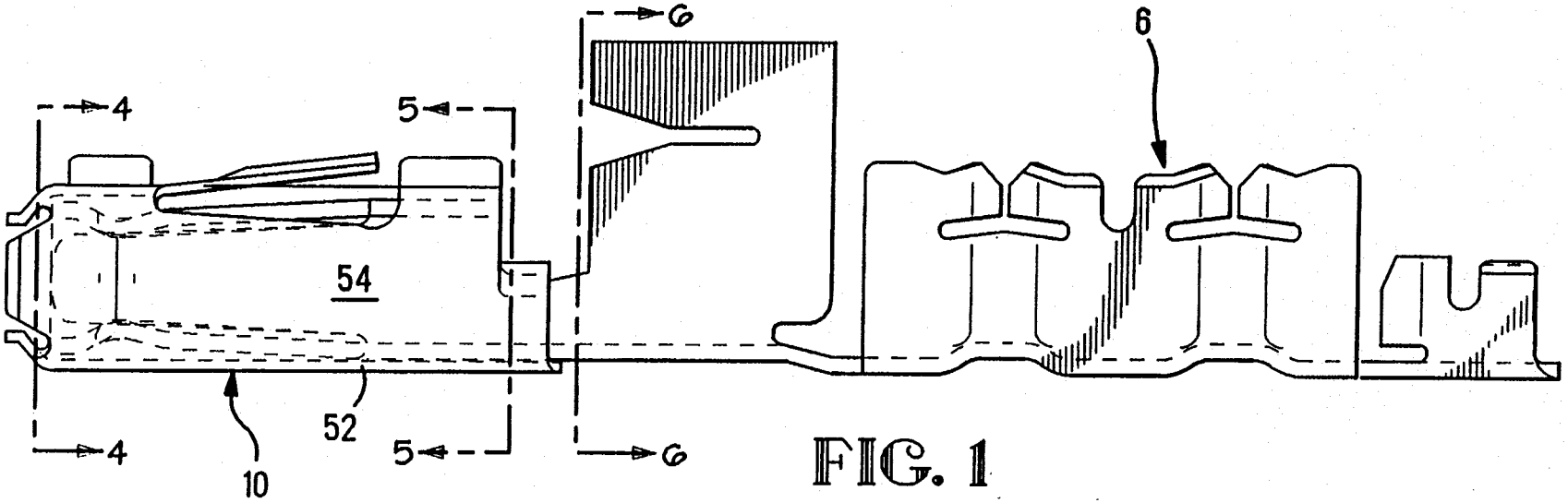
FIG. 1 is a side view of the assembled electrical contact for use in the airbag connector.

With reference now to FIG. 1, the electrical terminal is shown generally at 2 including a front contacting section 4 and a wire terminating section 6. As shown best in FIG. 3, the front mating contact section is shown as a box shaped receptacle at 8 having an overlying outer spring 10 (FIG. 1) in surrounding relationship.

Figure 3B:
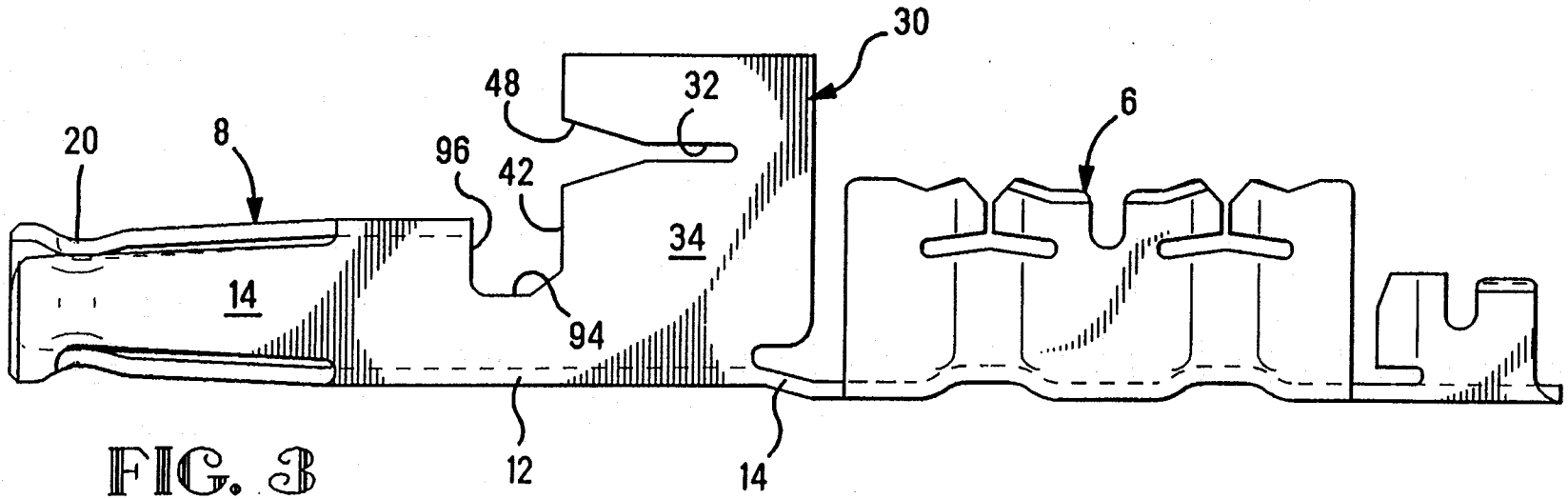
FIG. 3 is a side view similar to that of FIG. 1 without the outer spring attached.
Figure 5:
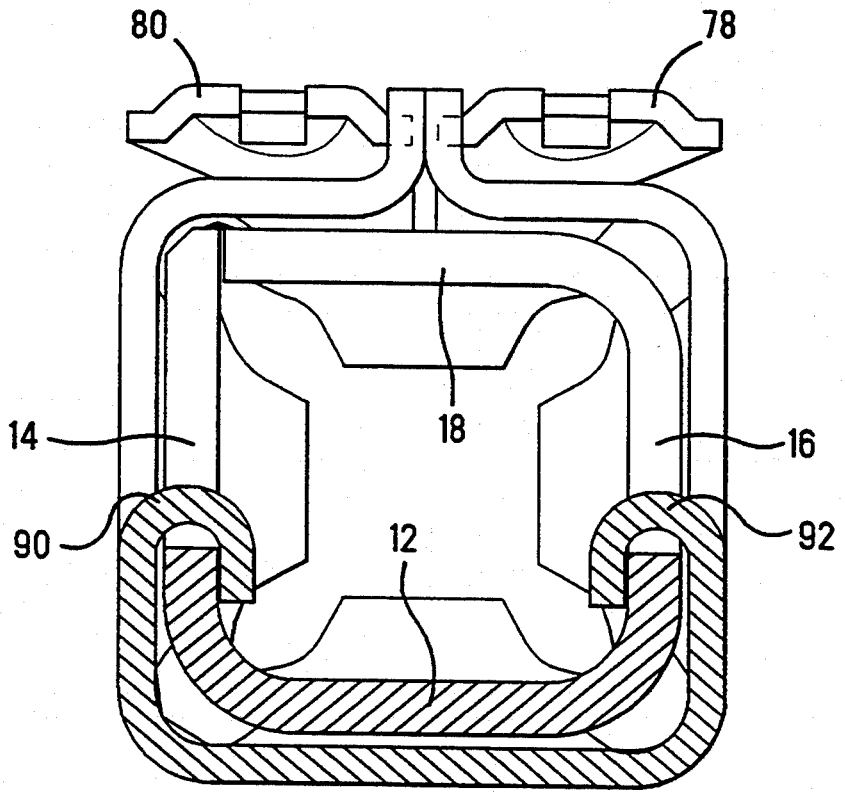
FIG. 5 is a cross-sectional view through lines 5—5 of FIG. 1.

As shown best in FIG. 3, the inner terminal includes a lower base section 12 which runs the substantial length of the terminal having a hinge section at 14 which carries the wire connection section 6. In the preferred embodiment of the invention the wire connecting section 6 is shown as an insulation displacement type slot, although a wire terminating section such as an F-crimp or similar connection could also be incorporated. Two side walls 15 and 16 upstanding from the base portion 12, as best shown in FIG. 5. As also shown in FIG. 5, a top wall portion 18 extends from the side wall portion 16 and is bent at a right angle relative to the side wall portion to form a substantially closed box. Each of the wall portions 12, and 15–18 extend forwardly and are constricted at 20 to form contact sections 22–28 respectively.

Figure 2:
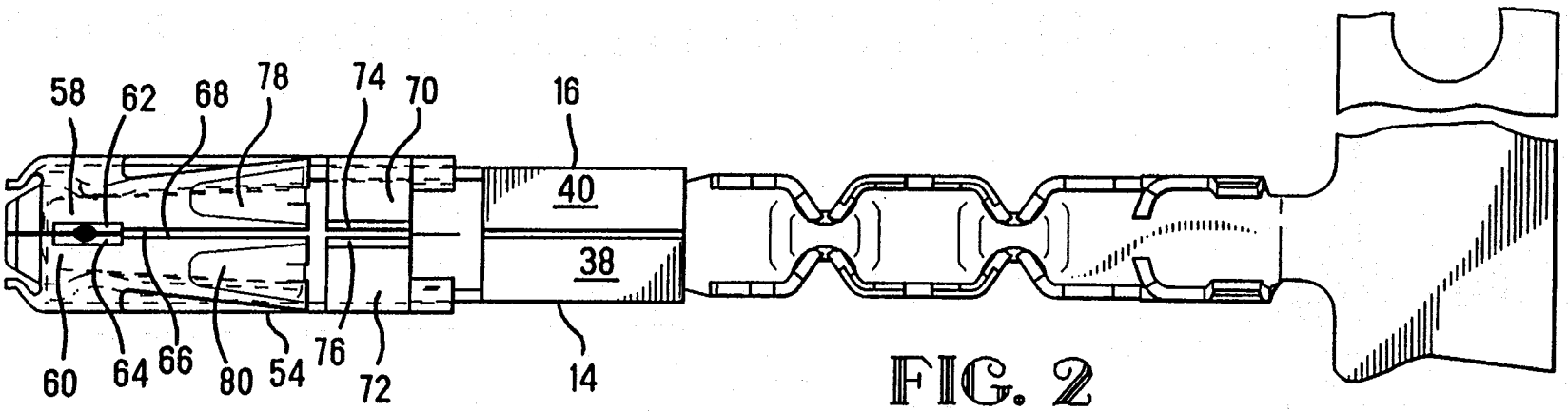
FIG. 2 is a top view of the terminal shown in FIG. 1.
Figure 6:
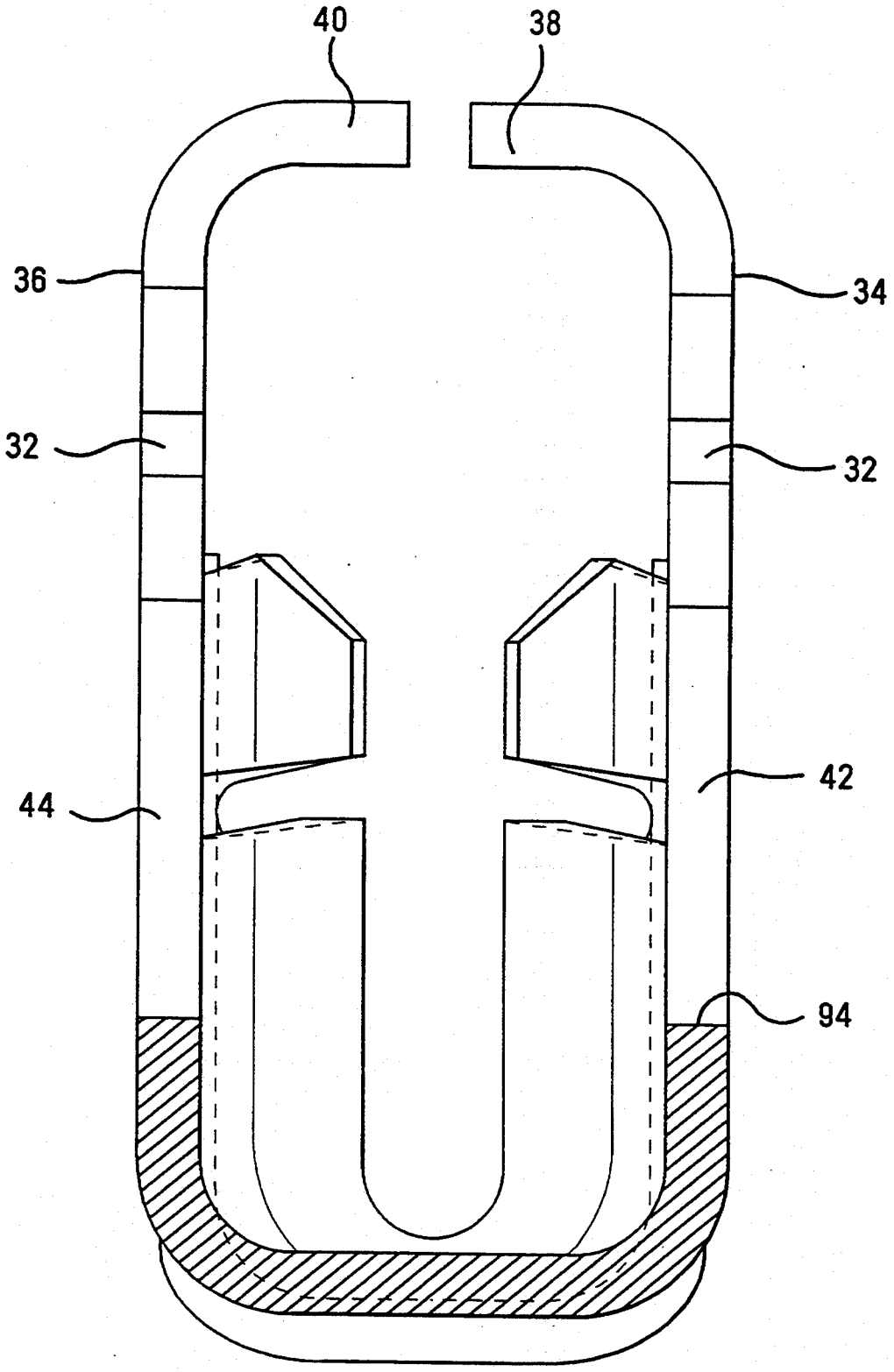
FIG. 6 is a cross-sectional view through lines 6—6 of FIG. 1.

A wire receiving slot section is shown at 30 which is profiled to receive a suppression device in the slot 32. This section 30 is profiled by upstanding wall sections 34 and 36 extending upwardly integral with respective wall sections 15 and 16. This section 30 also includes top cover portions 38 and 40, extending from respective extended wall portions 34 and 36 as best shown in FIGS. 2 and 6. Along the front edges 42 and 44 of respective wall portions 34 and 36 are located lead-in openings 48 for the slots 32.

Figure 4:
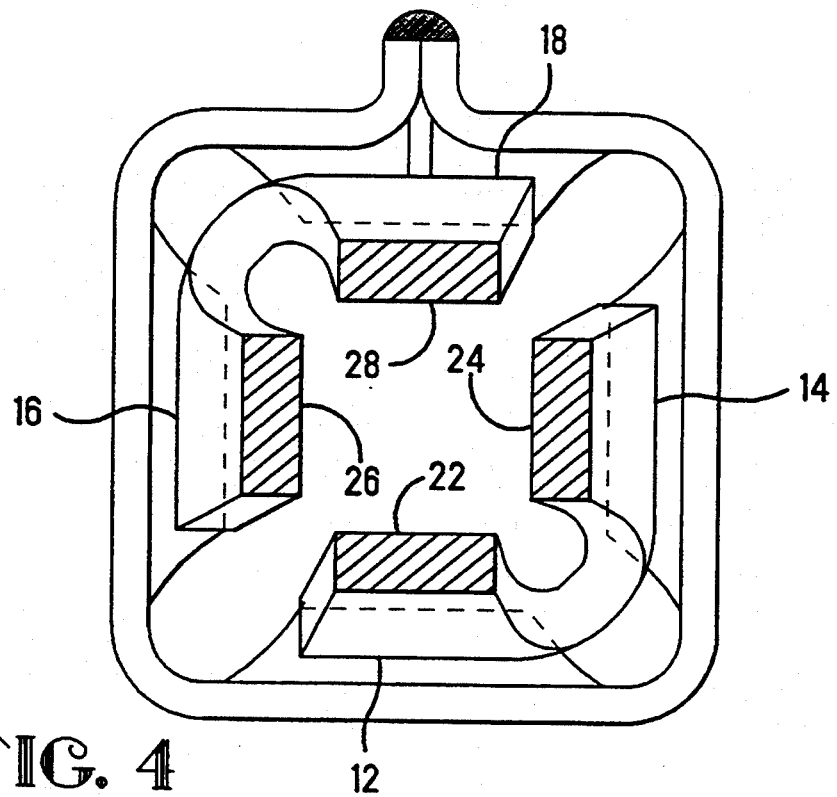
FIG. 4 is a cross-sectional view through lines 4—4 of FIG. 1.

With respect now to FIGS. 1 and 2, the outer spring 10 will be described in greater detail. The outer spring 10 comprises a lower base portion at 52 which lies substantially adjacent to lower base 12 of the inner contact portion and has side wall portions 54 and 56 which lie substantially adjacent to respective side wall portions 15 and 16 of the inner contact. The outer spring member 10 further includes top wall portions 58 and 60 (FIG. 2) adjacent to the front end of the terminal which are folded over to lie substantially adjacent to the top wall portion 18 of the inner contact. These top wall cover portions 58 and 60 include integral tabs 62 and 64 which extend from longitudinal seams 66 and 68, respectively. These tab portions 62 and 64 extend upwardly as shown in FIGS. 1 and 4 and are either welded or soldered together to fix the top wall portions 58 and 60 to hold them in a closed condition.

The outer spring member 10 further includes rear top wall portions 70 and 72 which further include upstanding tab portions at 74 and 76. The top wall sections 78 and 80 which are intermediate the top wall portions 58, 70; 60 and 72 respectively are separated from the side walls and along a rear edge thereby forming two discrete rearwardly facing locking lances, as best shown in FIGS. 2 and 5. As best shown in FIGS. 4 and 5, the tab portions 62,64 and 74,76 define a central polarizing rib where the locking lances 78 and 80 are positioned on opposite sides of the rib. The outer spring is also held to the contact member by way of tab portions 90 and 92 being clinched to the side walls 15 and 16 over an edge 94 formed in an opening 96 (FIG. 3).

Figure 7:
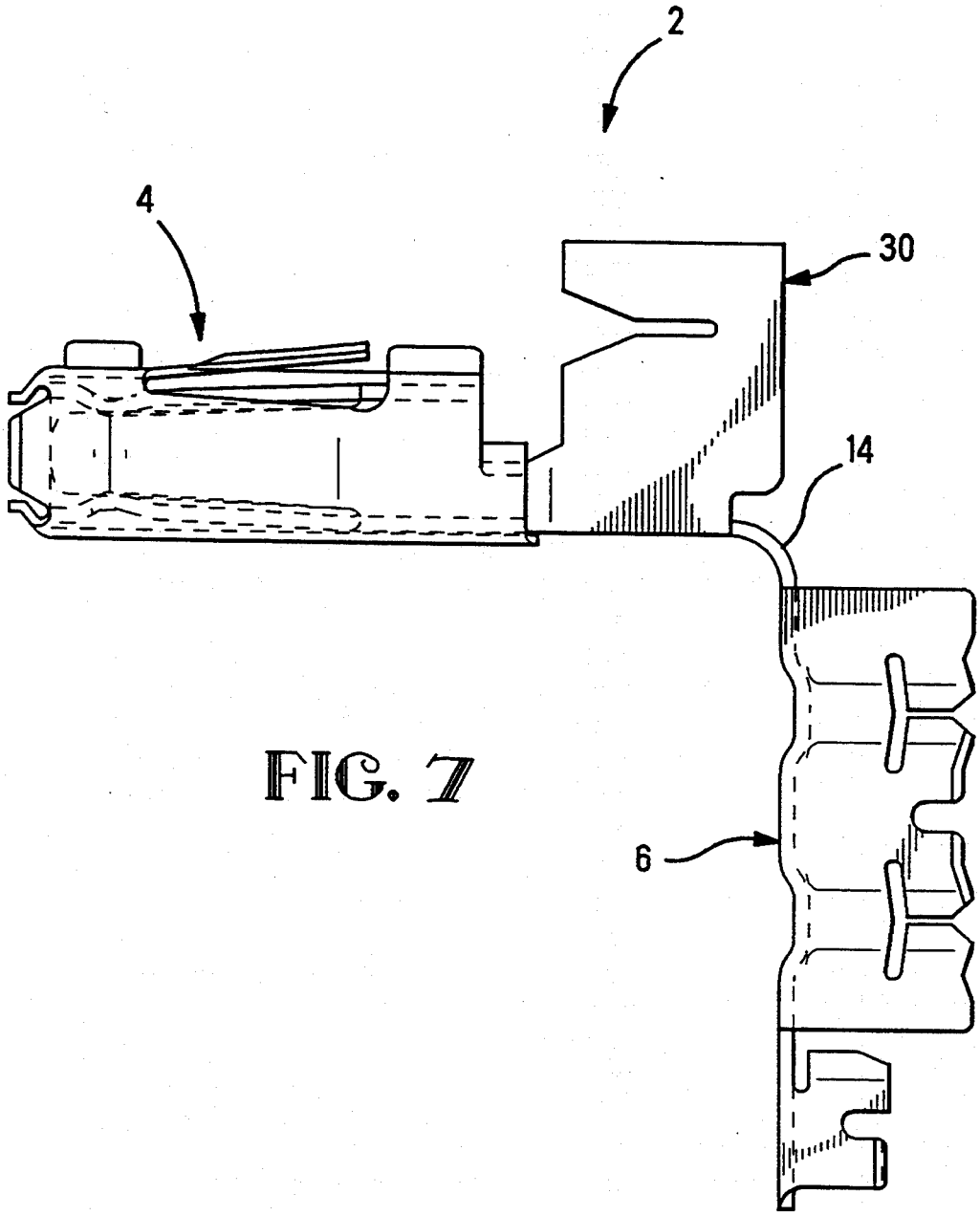
FIG. 7 is a view similar to that of FIG. 1, showing the terminal in a right angle configuration.
Figure 8:
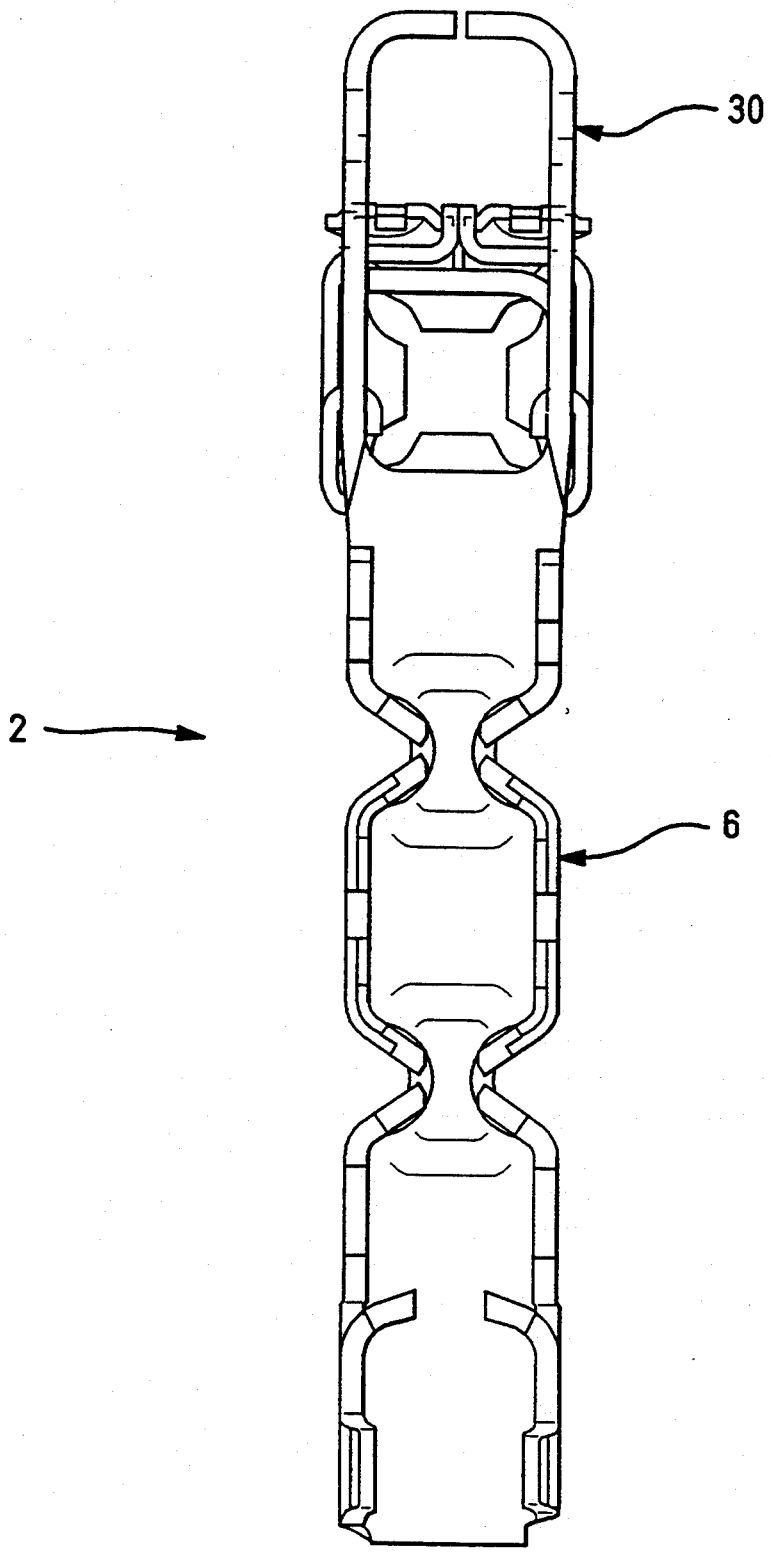
FIG. 8 is an end view of the terminal shown in FIG. 7.

As shown in FIGS. 7 and 8, the terminal 2 is rotatable about the web 14, to position the terminal into a right angle configuration.

Figure 9:
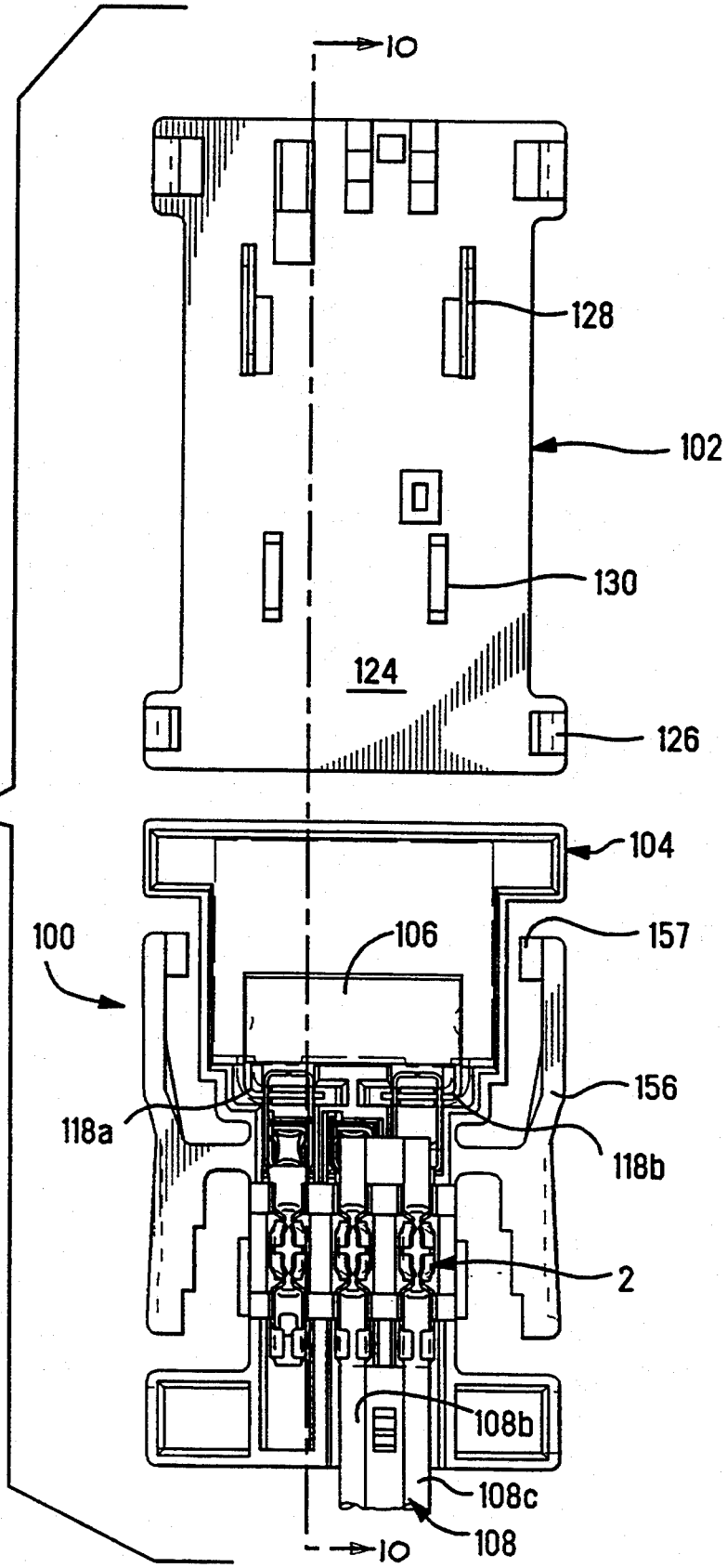
FIG. 9 is an upper plan view of the ignitor connector and housing cover shown in an unassembled manner.
Figure 10:
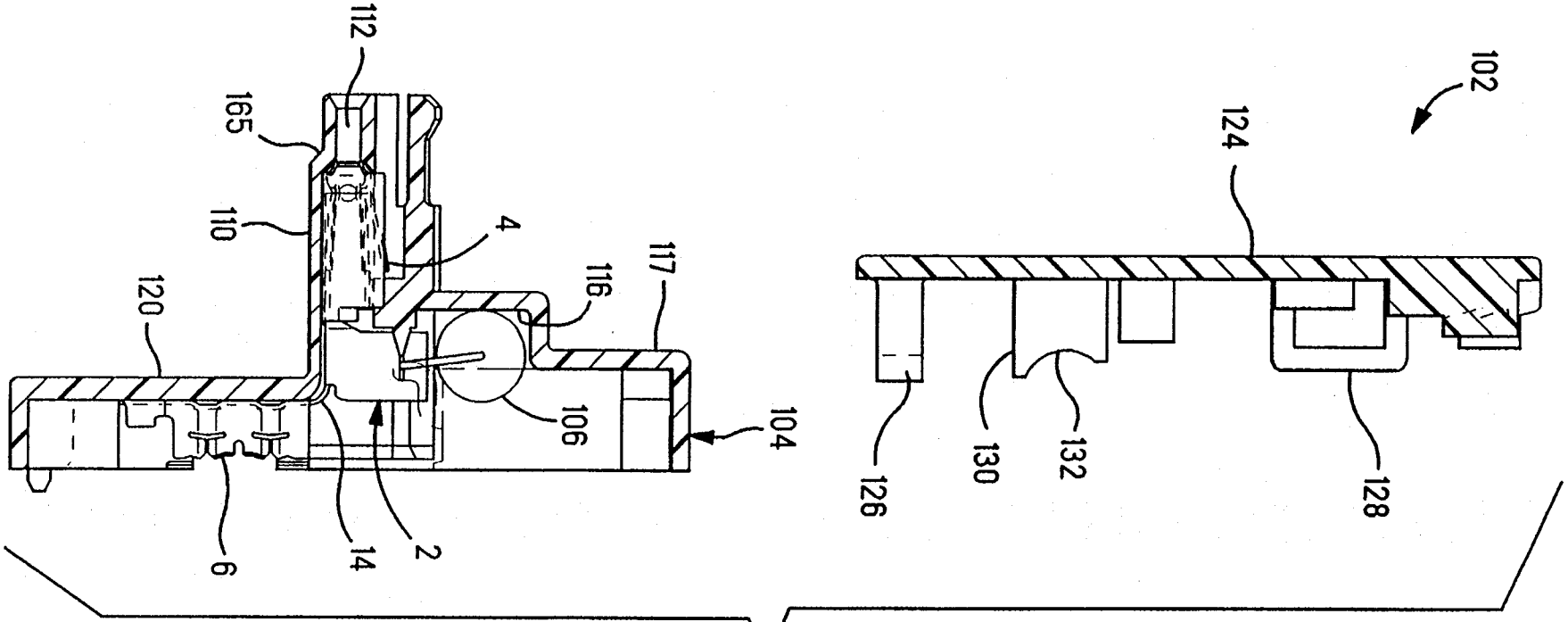
FIG. 10 is a cross-sectional view through lines 10—10 of FIG. 9.

With respect now to FIG. 9, the airbag connector is shown generally at 100 having a cover 102 where the connector 100 is generally comprised of an insulating housing 104, a plurality of the electrical terminals 2, a suppression device at 106, such as a resistor or capacitor, and electrical cable at 108. As shown best in FIG. 10, as the electrical terminal 2 is bendable about the web 14, the terminal 2 can be positioned in the housing 104 with the front mating portion 4 positioned in a front cavity section 110 of the housing, having a pin receiving opening 112 leading into the contact section 4. The housing 104 also includes a nest at 116 for receiving the suppression device 106. As shown in FIG. 9, the device 106 includes electrical leads **118*a*, 118*b* which are electrically connected to the slots 32 on two of the electrical terminals 2. The housing 104 further includes a housing portion 120 for receiving the wire connecting sections 6 of the electrical terminals 2. It should be appreciated that the housing is somewhat T-shaped in a cross section having oppositely directed parallel arm portions 117 and 120, and a perpendicular section 110. As shown in FIGS. 9 and 10, the cover 102 has an upper cover plate at 124 and latching arms such as 126, 128, and retention arms at 130 for maintaining the suppression device in place, having a circular surface 132 for engaging against the cylindrical suppression device 106**.

Figure 11:
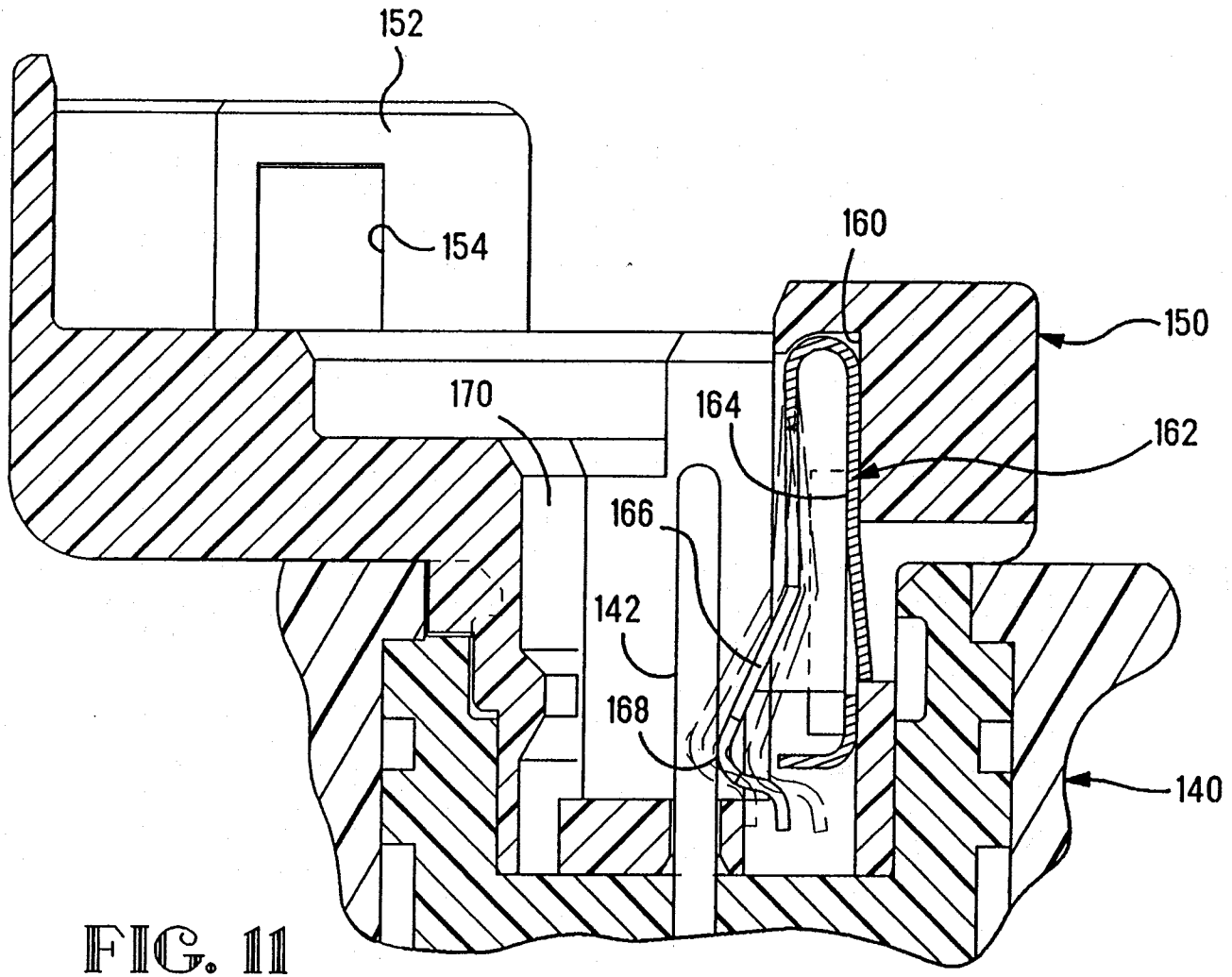
FIG. 11 is a cross-sectional view of a mating housing connected to the pins of the ignitor.

With respect now to FIG. 11, an ignitor for an airbag is shown generally at 140 which includes pin terminals at 142. A mating housing portion is shown at 150 including an outer shroud 152 for receiving the connector housing 104 and includes apertures at 154 for mating with latch elements 157 of latching arms 156 (FIG. 9) on the main housing. The housing 150 includes a cavity at 160 for holding a shunt spring 162 where the shunt spring 162 includes a base portion 164, a contact arm 166 having a cantilever spring beam 168 for contact against the pins 142 when in the unmated condition.

The housing 150 further includes a cavity 170 for receiving the connector 100, and as shown in FIG. 12 the connector 100 begins to mate with the housing portion 150, but where the shunt member 162 is still in engagement with the pin portions 142. It should be noted that a front edge 165 of the housing 100 engages the cantilever spring portion 168 in FIG. 10, and as shown in FIG. 13 has moved the shunt spring away from the pin terminals 142 when in the fully mated condition. When in the fully mated condition, the latch arms 156 carrying latching elements 157 towards the ends, are positioned in the apertures 154 (FIG. 11 maintaining the two in a fully mated condition).

Figure 14:
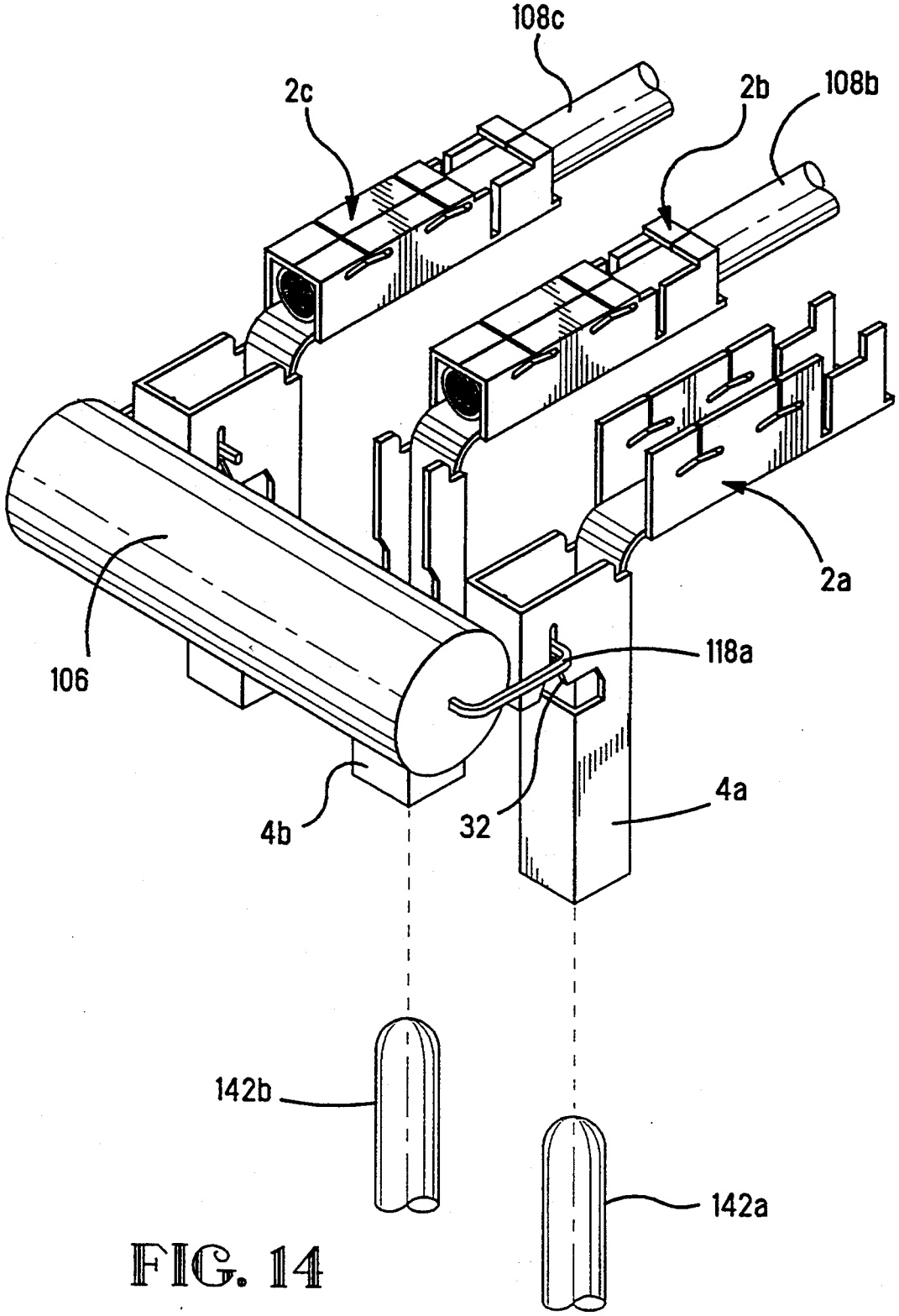
FIG. 14 shows a diagrammatical view of the manner in which the connector is electrically wired.

As shown in FIG. 14, the electrical connector 100 includes three terminals **2*a*, 2*b*, and 2*c* where the suppression device 106 has a lead 118*a* terminated to the slot 32 of terminal 2*a*. The opposite lead 118*b* is terminated to the slot 32 of the terminal 2*c*. The terminal 2*a* is not terminated to a lead, such as 108*b* or 108*c*, whereas the terminal 2*c* has no mating contact section. Thus the serial signal connection is from pin 142*a* to contact 4*a*, through the suppression device 106, to the lead 108*c*, to the lead 108*b*, and back to the igniter pin 142*b***.

We claim:

1. An electrical connector having a suppression device electrically connected between terminals in a housing, the connector being characterized in that the housing has a receiving section for a suppression device, and in that the terminals each include an additional wire receiving slot, where leads of the suppression device are terminated in the additional wire receiving slots, said housing is T-shaped in cross section and is comprised of arm members and a perpendicular member, wherein terminal receiving passageways are located in the perpendicular member.

2. The electrical connector of claim 1, characterized in that the terminals are formed at a right angle, being bent behind the additional wire receiving slot.

3. The electrical connector of claim 2, characterized in that the additional wire receiving slot faces a front end of said terminal receiving passageway.

4. The electrical connector of claim 3, characterized in that the additional wire receiving slot is formed in a box-shaped section of the terminal, rearward of a front contact section of the terminal.

5. The electrical connector of claim 1, characterized in that the terminals include wire contacting sections formed at a right angle behind said additional wire receiving slot, said wire contacting sections being positioned on a base of one of said arm members.

6. The electrical connector of claim 5, characterized in that the opposite arm member of the housing includes a suppression device receiving nest.

7. An electrical connector for electrical connection to electrical leads of an electrical component, comprising;

a dielectric housing having a central section and arm members disposed substantially normal thereto;

electrical terminals having contact section disposed in said central section and wire terminating sections positioned in one of said arm members; and component terminating sections on said electrical terminals between said contact sections and said wire terminating sections including an opening for receiving the electrical lead therein for terminating the electrical leads of the electrical component thereto.

8. An electrical connector as claimed in claim 7, wherein a component-receiving area is located in the other of said arm members in which the electrical component is to be disposed.

9. An electrical connector as claimed in claim 7, wherein said component-terminating sections are directed toward a front end of said central section.

10. An electrical connector as claimed in claim 7, wherein a cover member is securable onto said housing and includes retention members for engagement with the electrical component.

11. The electrical connector as claimed in claim 9, wherein a component receiving area is located in the housing, said component receiving area being open opposite the front end of said central section.

12. An electrical connector for interconnecting with terminals of a mating device, comprising:

a housing having a mating portion complementary to the mating device and an arm portion for receiving a plurality of conductive leads therein;

a suppression device having a pair of leads extending therefrom, said suppression device seated within the housing;

a first electrical terminal having a receiving section electrically engaging one of the leads of the suppression device and a contact section for engaging the terminal of the mating device, said first electrical terminal seated in the housing with the contact section disposed in the mating portion;

a second electrical terminal having a lead termination section for electrically engaging one of the conductive leads and a contact section for engaging one of the other terminals of the mating device, said second electrical terminal seated in the housing with the contact section disposed in the mating portion; and a third electrical terminal having a lead termination section for electrically engaging another of the leads and a receiving section electrically engaging the other lead of the suppression device, where said third electrical terminal is seated in the housing and the receiving section thereof engages the respective lead of the suppression device in a solderless manner.

13. The electrical connector of claim 12, wherein the lead termination sections form a solderless interconnection with the respective conductive leads.

14. The electrical connector of claim 13, wherein the lead termination sections are of insulation displacement contact construction.

15. The electrical connector of claim 12, wherein the lead termination sections are open for receiving the conductive lead from thereabove.

16. The electrical connector of anyone of claims 12–15, wherein the receiving section is a wire engaging slot.

17. The electrical connector of claim 16, wherein the wire engaging slot is open in a direction corresponding to the insertion direction of the corresponding terminal into the housing.

18. The electrical connector of claim 17, wherein the housing supports the leads of the suppression device in a nest while the wire engaging slot engages therewith upon insertion of the terminal.

19. The electrical connector of claim 12, wherein the housing includes a pair of opposing arms from which the mating portion extends downwardly therefrom, thereby forming a T-shaped cross-section.

20. The electrical connector of claim 17, wherein the lead termination sections and the wire engaging slot are open in opposite directions.

21. The electrical connector of claim 12, wherein all the electrical interconnections are solderless.

22. The electrical connector of claim 12, wherein the housing is open in the upward direction and the suppression device, contacts and conductors are sequentially received therein, the connector further comprising a cover thereover.

23. The electrical connector of claim 16, wherein the lead termination sections of the second and third electrical terminals are disposed in the arm portion of the housing.

24. The electrical connector of claim 19, wherein the suppression device is disposed in the second arm.

* * * * *